US005484295A

United States Patent [19]

Mowry et al.

[11] Patent Number: 5,484,295

[45] Date of Patent: Jan. 16, 1996

[54] LOW PROFILE COMPRESSION ELECTRICAL CONNECTOR

[75] Inventors: Thomas E. Mowry, Cardiff; Peter A. Kurbikoff, San Diego, both of Calif.

[73] Assignee: Teledyne Electronic Technologies, San Diego, Calif.

[21] Appl. No.: 222,653

[22] Filed: Apr. 1, 1994

[51] Int. Cl.[6] ..... H01R 9/09

[52] U.S. Cl. ..... 439/66; 439/65

[58] Field of Search ..... 439/65, 66

[56] References Cited

U.S. PATENT DOCUMENTS

| | | | |
|---|---|---|---|
| 3,673,545 | 6/1972 | Rundle . | |
| 3,731,252 | 5/1973 | McKeown et al. . | |
| 3,960,424 | 6/1976 | Weisenburger . | |
| 3,969,010 | 7/1976 | Nailor, III et al. . | |
| 4,204,205 | 5/1980 | Yagi et al. . | |
| 4,295,700 | 10/1981 | Sado . | |
| 4,395,084 | 7/1983 | Conrad . | |
| 4,402,562 | 9/1983 | Sado . | |
| 4,445,735 | 5/1984 | Bonnefoy . | |
| 4,636,018 | 1/1987 | Stillie . | |
| 4,693,529 | 9/1987 | Stillie | 439/65 X |
| 4,699,593 | 10/1987 | Grabbe et al. . | |
| 4,867,689 | 9/1989 | Redmond et al. . | |
| 4,976,629 | 12/1990 | Werner . | |
| 4,998,886 | 3/1991 | Werner . | |
| 5,088,929 | 2/1992 | Enomoto | 439/66 OR |
| 5,147,207 | 9/1992 | Mowry . | |
| 5,160,268 | 11/1992 | Hakamian . | |
| 5,161,982 | 11/1992 | Mowry . | |
| 5,308,252 | 5/1994 | Mroczkowski et al. | 439/66 OR |
| 5,378,160 | 1/1995 | Yumibe et al. | 439/65 X |

*Primary Examiner*—Larry I. Schwartz
*Assistant Examiner*—Daniel Wittels
*Attorney, Agent, or Firm*—Nydegger & Associates

[57] ABSTRACT

A low profile compression electrical connector, for establishing an electrical pathway between two electrical components, includes an insert and a housing. A plurality of connector arms are mounted on a base of the insert, and each connector arm has a first end and a second end. The ends are sufficiently deflectable to allow the connector to fit into a very small space. The housing of the electrical connector is formed with an aperture for receiving and stationarily orienting the base of the insert with respect to the housing. Also, clamps mounted on the housing can be used to hold first and second electrical components, such as printed circuit boards, against the housing and in contact with the ends of the connector arms. Upon engagement of the electrical components with the housing, the ends of the connector arms urge against the electrical components to establish an electrical pathway through the connector arm from the first electrical component to the second electrical component.

9 Claims, 3 Drawing Sheets

LOW PROFILE COMPRESSION ELECTRICAL CONNECTOR

FIELD OF THE INVENTION

The present invention pertains generally to electrical connectors. More specifically, the present invention relates to electrical connectors which have a low profile and which, therefore, reduce the distance between electrically interconnected components. This invention is particularly, but not exclusively, useful for completing electrical circuits between juxtaposed printed circuit boards.

BACKGROUND OF THE INVENTION

Electrical systems typically incorporate several electrical components which require reliable interconnection for the proper operation of the system. For many applications it is necessary for systems to be as small and as compact as possible. Accordingly, many efforts have been made to miniaturize the individual components of electrical systems. Further, as electrical components in the electrical systems have become miniaturized, the need has also arisen to decrease the size of the connectors which establish electrical pathways between the components. Additionally, these connectors must be able to easily accommodate the removal and replacement of system components without diminishing system performance.

A large variety of electrical connectors have been designed and developed for use in providing electrical connections between the various components of electrical systems. One type of electrical connector that has been used for this purpose relies on a deflectable contact arm. Typically, the contact arms of such connectors have fixed ends attached to a base, and they have deflectable ends which extend from the base to establish electrical contact with the electrical component. For this type of connector, the electrical component is placed against or near the base to compress the deflectable end of the contact arm. This juxtaposition of the base and the component results in the deflectable end of the contact arm being urged against an electrical pad on the electrical component. With electrical contact between the component and the deflectable end of the contact arm, the fixed end provides electrical access to the electrical component from another electrical device. An example of such a connector is disclosed in U.S. Pat. No. 5,161,982 which issued to Mowry for an invention entitled, "Reactive Base For Cantilevered Connector" which is assigned to the same assignee as the present invention.

While some applications, such as the device disclosed in Mowry '982 patent as discussed above, are more directed toward establishing electrical access to a single electrical component, it is also sometimes desirable to use a single connector to establish direct electrical contact between two electrical components. An example of a two component connector that also incorporates deflectable contact arms is disclosed in U.S. Pat. No. 5,147,207 which issued to Mowry for an invention entitled "Balanced Pressure Connector", and which is assigned to the same assignee as the present invention. The '207 patent which issued to Mowry is more directed toward a connector in which a base is used for both establishing the electrical connection between two electrical components and for providing an anchoring system with which the electrical components are held relative to the base. As a result, the size of the connector is substantial in order to serve this dual purpose. Specifically, in Mowry '207, the connector base and the electrical components have holes for bolts which hold the electrical components to the connector. Miniaturizing such a connector to reduce the space between the electrical components would weaken the base and thereby diminish the quality of the anchoring of the electrical components to the connector base.

Devices for electrically interconnecting two components, however, typically require the connector to be somehow physically held to the components. With this in mind, the present invention recognizes that a connector base can be mounted as an insert within a housing. Additionally, the electrical components can be anchored to the housing rather than to the connector base. Thus, the connector base can be reduced in size, because the insert is only providing an electrical pathway between the electrical components. In a connector insert mounted within a housing, the following considerations must be addressed: 1) the necessary force must be generated between the deflectable contact arm and the electrical component to ensure a functional and reliable electrical connection; 2) the necessary degree of deflection of the contact arms must be provided to make the proper electrical connections; 3) the proper registration of the electrical connector insert with the housing must be provided to ensure accurate electrical connections; and 4) longevity and repeatability of the electrical connection between the electrical components must be ensured.

In light of the above, it is an object of the present invention to provide an electrical connector which has an extremely low profile. It is another object of the present invention to provide an electrical connector which minimizes the space between interconnected electrical components. Still another object of the present invention is to provide a low profile electrical connector with deflectable arms that generate sufficient force to maintain a proper electrical connection. Yet another object of the present invention is to provide a means for accurately aligning a low profile electrical connector with the electrical components which are to be connected. Further, it is an object of the present invention to provide a low profile electrical connector which is relatively easy to manufacture and comparatively cost-effective.

SUMMARY OF THE INVENTION

An electrical connector in accordance with the present invention includes an insert mounted in a housing plate. The insert includes a nonconductive base having a first side and a second side. A plurality of contact arms, each having a first end and a second end, are mounted on the base. Each contact arm provides an electrical pathway between its two ends. The first and second ends of the contact arms respectively extend from the first side and the second side of the base and each end is deflectable relative to the base. A contact point is formed on each first and second end of the contact arms. Each contact point can be shaped as a substantially hemispherical surface or a substantially conical surface. In fact, the contact points may take various geometric shapes, depending on the particular use for the connector. Additionally, the base includes a plurality of recesses, each recess being shaped and positioned on the base to receive an end of a contact arm as the end is deflected toward the base.

A substantially flat housing plate is provided which has a first side and a second side corresponding to the first side and the second side of the base. The housing plate also has an aperture formed between the two sides for receiving the insert therein to orient the insert on the housing plate. At least one key is formed on the base and at least one key slot is formed on the housing plate. When the base is positioned in the aperture, the key mates with the key slot to ensure proper orientation of the base relative to the housing plate.

A first electrical component and a second electrical component are respectively positioned against the first side and the second side of the housing plate. Clamps which are mounted on the housing plate engage each of the electrical components with its respective side of the housing plate to bring the component into electrical contact with the ends of the base-mounted contact arms. Thus, electrical connections are established between the two electrical components through the contact arms as the first electrical component makes electrical contacts with the first ends of the connector arms and the second electrical component makes electrical contacts with the second ends of the connector arms. Most importantly, due to the nesting relationship between the insert and the housing plate when the electrical components are juxtaposed with the housing plate, the distance between electrically interconnected components can be held to less than approximately one hundred and twenty thousandths (0.120) of an inch. Generally, the electrical components are printed circuit boards.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF PREFERRED EMBODIMENTS

Figure 1:
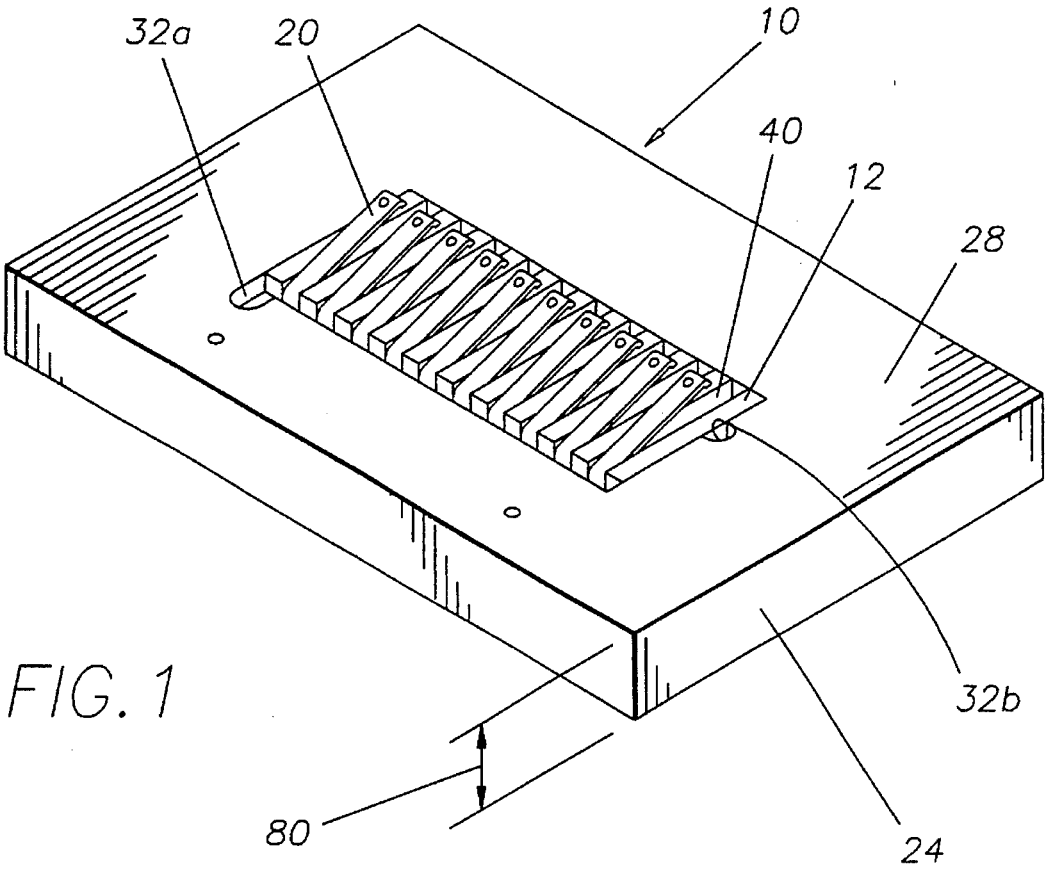
FIG. 1 a perspective view of the electrical connector of the present invention.
Figure 2:
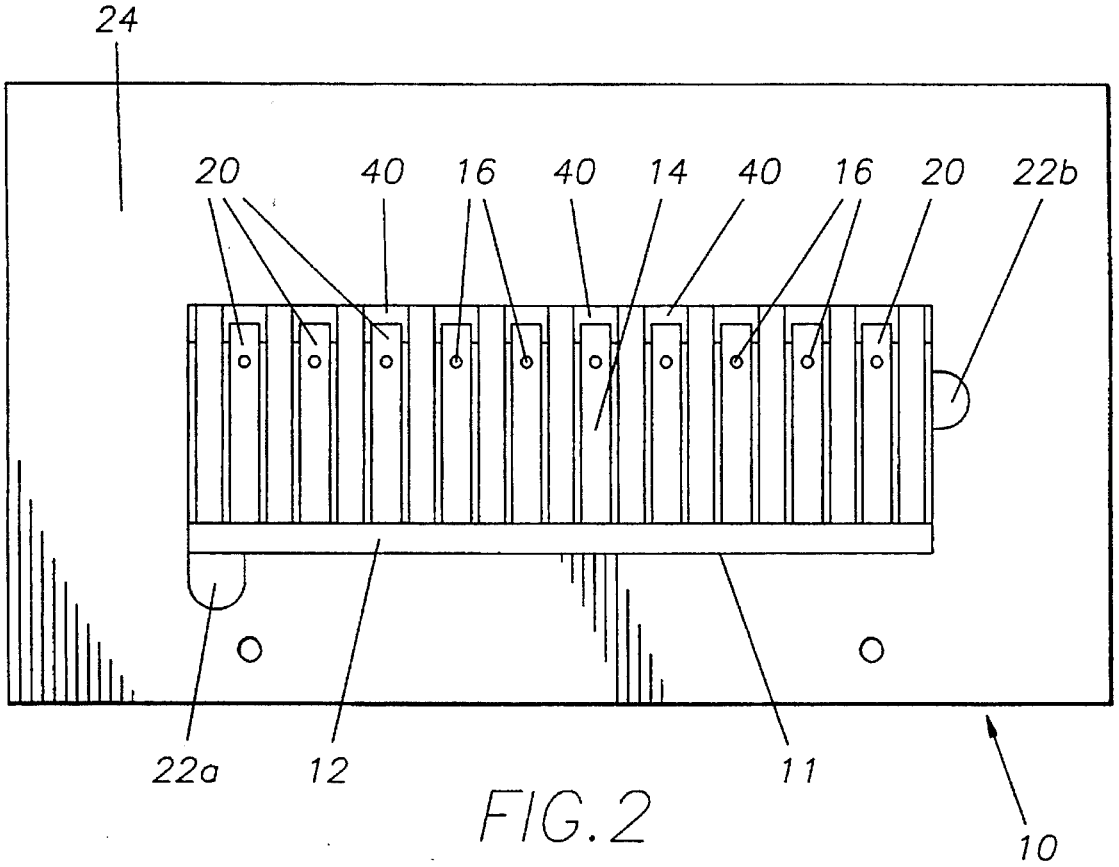
FIG. 2 is a plan view of the electrical connector shown in FIG. 1.
Figure 3:
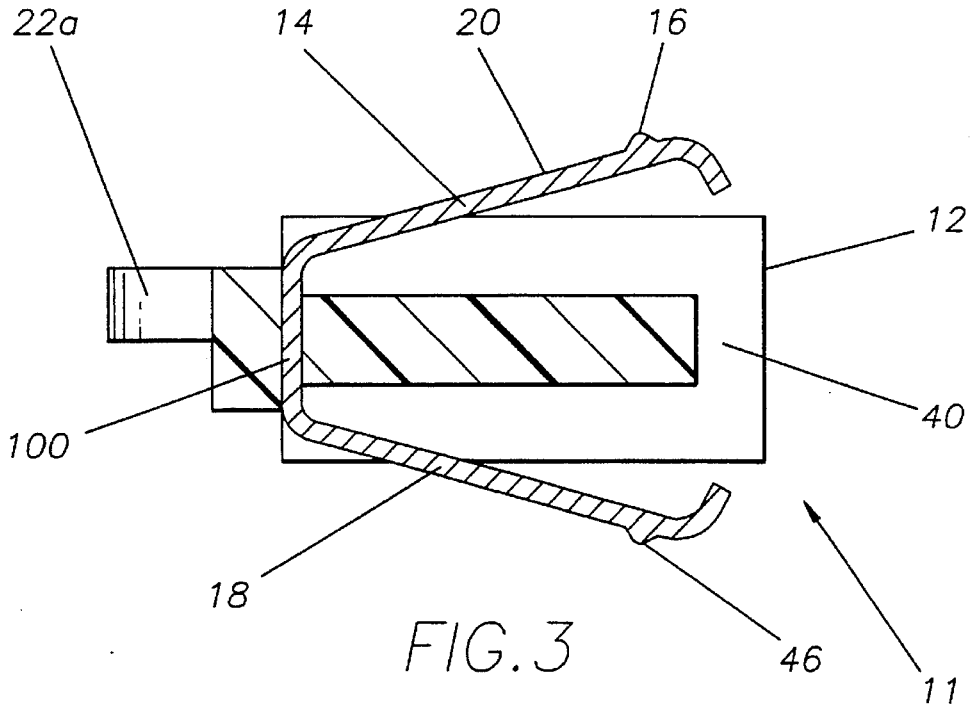
FIG. 3 is a cross-sectional view of the insert of the electrical connector.

Referring initially to FIGS. 1 and 2, a low profile compression connector is shown and generally designated by the numeral 10. As shown, the connector 10 includes an insert 11 and a housing plate 24. The main structural component of insert 11 is a base 12 of molded plastic or other dielectric material. A plurality of flexible contact arms 20 are mounted to base 12. As seen in FIG. 3, medial portion 100 of each contact arm 20 is molded within base 12. Each contact arm 20 has a first contact end 14 and a second contact end 18. Each first contact end 14 has a first contact point 16. Similarly, each second contact end 18 has a second contact point 46. First and second contact points 16,46 can be shaped as a substantially hemispherical surface, or they can be shaped as a substantially conical surface. The shape of contact points 16,46 can be many different geometric forms, depending on the operational requirements of connector 10. As will be shown, electrical components are interconnected through contact arms 20 by making electrical connections with first contact points 16 and second contact points 46.

Connector 10 is shown as being formed with ten contact arms 20. Connector 10 could be formed with any number of contact arms, as required by a particular application.

Connector 10 has U-shaped recesses 40 formed on base 12, each recess 40 shaped to receive a first contact end 14 and a second contact end 18. Further, base 12 is formed having a plurality of keys **22*a*, 22*b***.

Figure 4:
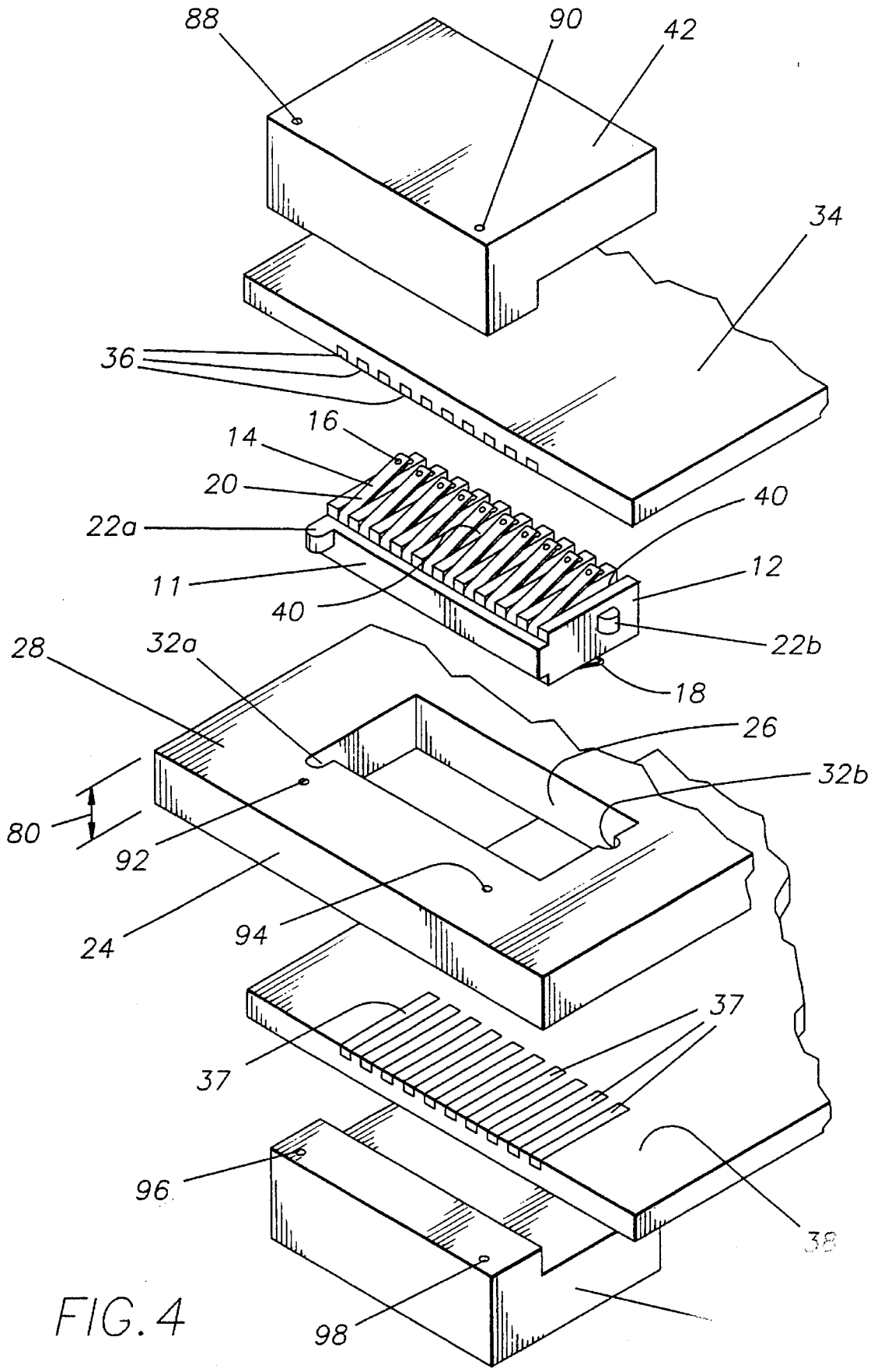
FIG. 4 is a perspective view of the electrical connector shown in FIG. 1, in an exploded relationship showing electrical components that will be electrically connected by the connector.

Base 12 is shaped to be positioned in housing plate 24. More specifically, as shown in FIG. 4, housing plate 24 has an aperture 26 extending therethrough, shaped to receive base 12. Within aperture 26 are key slots **32*a*, 32*b*. When base 12 is properly positioned within aperture 26, keys 22*a*, 22*b* of base 12 mate with respective key slots 32*a*, 32*b* of housing plate 24. This arrangement of keys 22*a*, 22*b* and key slots 32*a*, 32*b* results in the accurate registration of base 12 within housing plate 24. This accurate registration is essential for ensuring that connector 10 aligns accurately with the electrical components which are to be connected. Base 12 can merely fit within aperture 26, and base 12 is not necessarily mounted or affixed to housing plate 24. More importantly, as shown later, the present invention does not require any means to mount or affix base 12 to electrical components which are interconnected by connector 10**. Typically, these electrical components are printed circuit boards.

Figure 5:
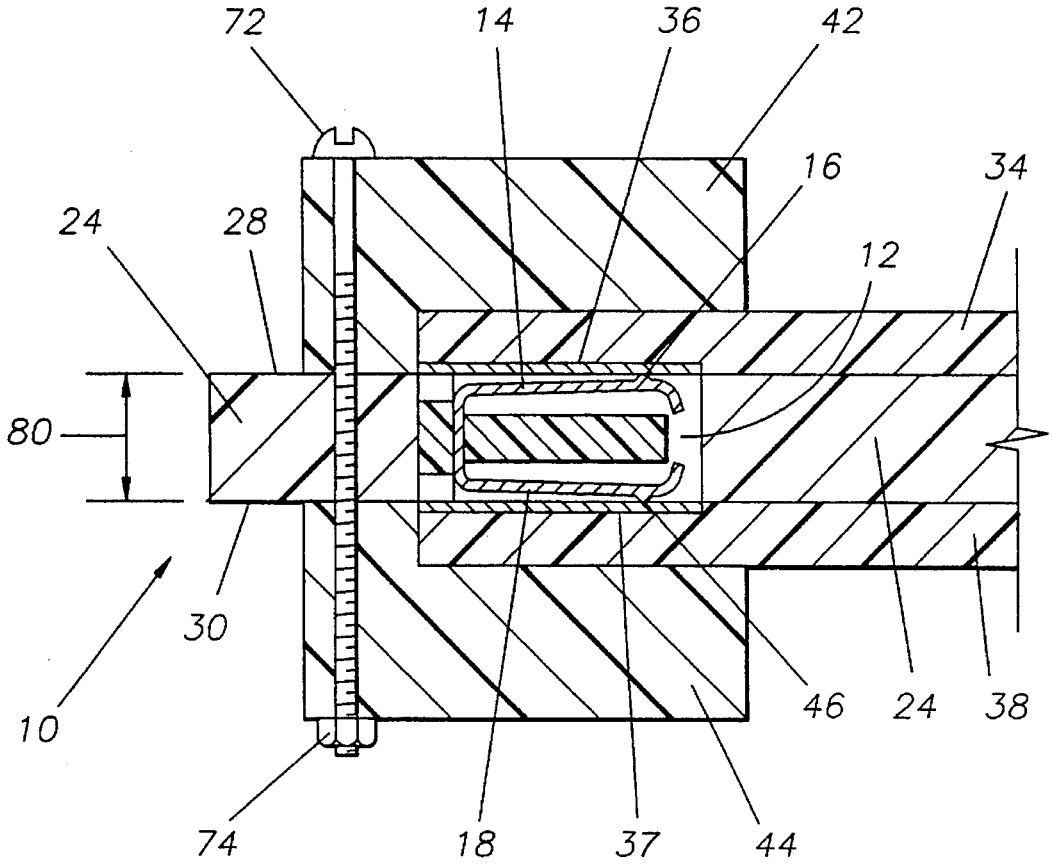
FIG. 5 is a cross-sectional view of the electrical connector as shown in FIG. 4, with the connector and the electrical components assembled.

FIG. 4 shows a first printed circuit board 34 and a second printed circuit board 38 which are to be interconnected by connector 10. More specifically, as shown in FIG. 5, first printed circuit board 34 will engage with first side 28 of housing plate 24. If properly positioned, the contact pads 36 of first printed circuit board 34 will establish electrical connections with first contact ends 14 of contact arms 20 at first contact points 16. Similarly, second printed circuit board 38 will engage with second side 30 of housing plate 24. If properly positioned, the contact pads 37 of second printed circuit board 38 will establish electrical connections with second contact ends 18 of contact arms 20 at second contact points 46.

As a consequence of the placement of base 12 within aperture 26, first printed circuit board 34 can be positioned at a distance from second printed circuit board 38 which is effectively equal to the thickness of housing plate 24. In the preferred embodiment, this thickness is denoted by arrow 80 and is less than approximately one hundred and twenty thousandths (0.120) of an inch.

Referring again to FIG. 3, a medial portion 100 of contact arm 20 is shown molded within base 12. A first contact end 14 extends from a first end of medial portion 100. Contact end 14 obliquely extends from medial portion 100. As a result, first contact end 14 is positioned over base 12. Similarly, a second contact end 18 extends from a second end of medial portion 100. Second contact end 18 obliquely extends from medial portion 100. As a result, second contact end 18 is positioned below base 12.

As illustrated in FIG. 3, first contact end 14 and second contact end 18 are shown in the undeflected position. The undeflected position of first contact end 14 occurs when first printed circuit board 34 is not engaged with first side 28 of housing plate 24. Similarly, the undeflected position of second contact end 18 occurs when second printed circuit board 38 is not engaged with second side 30 of housing plate 24. When first printed circuit board 34 and second printed circuit board 38 engage with their respective sides of housing plate 24, first contact points 16 are forced against pads 36 of first printed circuit board 34, and second contact points 46 are forced against pads 37 of second printed circuit board 38. As a result, first contact end 14 is urged into the deflected position shown in FIG. 5. Similarly, second contact end 18 is urged into the deflected position. In the deflected position, first contact end 14 and second contact end 18 are positioned within recess 40. Most importantly, the distance between first contact point 16 and second contact point 46, in the deflected position, is less than approximately one hundred and twenty thousandths (0.120) of an inch.

In FIG. 5, first printed circuit board 34 and second printed circuit board 38 are illustrated in the engaged position with connector 10. Specifically, the presence of first printed circuit board 34 between first clamp 42 and base 12 forces first contact ends 14 into the deflected position. Likewise, the presence of second printed circuit board 38 between second clamp 44 and base 12 forces second contact ends 18 into the deflected position. As a result, first contact points 16 are forced against pads 36 of first printed circuit board 34. Similarly, second contact points 46 are forced against pads 37 of second printed circuit board 38. Consequently, first printed circuit board 34 is electrically connected to second printed circuit board 38 through the electrical pathway established by contact arms 20.

As shown in FIGS. 4 and 5, first clamp 42 and second clamp 44 are mounted to housing plate 24 by screws 72 and nuts 74, through holes 88, 90, 92, 94, 96 and 98. When first clamp 42 is mounted to housing plate 24 with the presence of first printed circuit board 34 positioned against first side 28 of housing plate 24, first contact points 16 wipe or cut into pads 36 of first printed circuit board 34. Similarly, when second clamp 44 is mounted to housing plate 24 with the presence of second printed circuit board 38 positioned against second side 30 of housing plate 24, second contact points 46 wipe or cut into pads 36 of second printed circuit board 38. Contact arms 20 are formed from sufficiently stiff metal to exert a force of at least 150 grams against contact pads 36,37 in the deflected position. Consequently, gas tight electrical contacts result between pads 36 of first printed circuit board 34 and first contact points 16. Gas tight electrical contacts also occur between pads 37 of second printed circuit boards 38 and second contact points 46. These gas tight electrical contacts are adequate to maintain electrical connections with voltages as low as four volts.

While the particular low profile electrical connector as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

We claim:

1. An electrical connector which comprises:

a flat base having a first side, a second side opposite said first side, a first edge, and a second edge opposite said first edge;

a U-shaped recess in said base, said recess consisting of a first open groove on said first side of said base, a second open groove on said second side of said base, and a medial open groove along said first edge of said base, said medial open groove joining said first and second open grooves to form a U-shaped recess wrapping around both said sides and said first edge of said base;

a substantially U-shaped contact arm having a substantially straight medial portion, a substantially straight first contact end and a substantially straight second contact end, said medial portion of said contact arm being mounted in said base near said second edge, said medial portion extending through said base from said first open groove to said second open groove, with said first contact end extending along said first open groove at an oblique angle from said medial portion and said second contact end extending along said second open groove at an oblique angle from said medial portion; and a substantially flat housing having a first side corresponding to said first side of said base and a second side corresponding to said second side of said base, said housing being formed with an aperture therethrough for receiving and stationarily holding said base in said aperture to respectively project said first end and said second end of said contact arm from said first side and said second side of said housing to establish an electrical pathway from said first side to said second side of said housing through said contact arm.

2. A connector as recited in claim 1 further comprising:

means for mounting a first electrical component against said first side of said housing in electrical contact with said first end of said contact arm; and means for mounting a second electrical component against said second side of said housing in electrical contact with said second end of said contact arm, to establish an electrical connection between said first electrical component and said second electrical component.

3. A connector as recited in claim 1 wherein:

each said contact end has a curved outer extremity; and said contact arm is mounted on said base for deflection of said first and second contact ends into said first and second open grooves, respectively, and for deflection of said curved outer extremities into said medial open groove to achieve the lowest possible profile.

4. A connector as recited in claim 1 further comprising:

a first contact point formed as a substantially hemispherical surface on said first end of said contact arm; and a second contact point formed as a substantially hemispherical surface on said second end of said contact arm.

5. A connector as recited in claim 1 wherein a plurality of said contact arms are mounted on said base.

6. A connector as recited in claim 1 further comprising a plurality of said recesses formed in said base, each said end of said contact arm being receivable in one respective said recess.

7. A connector as recited in claim 1 further comprising:

a key formed on said base; and a key slot formed on said housing, said key slot being shaped to receive said key to orient said base within said aperture.

8. A connector as recited in claim 7 wherein:

a plurality of keys are formed on said base; and a plurality of key slots are formed on said housing, each said key being receivable in a respective said slot for orienting said base relative to said housing.

9. A connector as recited in claim 1 wherein said base is composed of a dielectric material.

* * * * *